United States Patent [19]

Hagiwara et al.

[11] Patent Number: 4,645,133

[45] Date of Patent: Feb. 24, 1987

[54] LINER FOR THE OUTLET PORT OF A ROD MILL

[75] Inventors: Tatsuo Hagiwara, Funabashi; Keiji Imai, Ibaraki; Shigenori Nagaoka, Chiba; Shinji Kogumazaka, Funabashi; Kyoichi Yahagi, Matsudo; Takeshi Imagawa, Ibaraki; Hidenaga Ishii, Tokyo; Toshitsugu Kikuchi, Takasaki, all of Japan

[73] Assignees: Kawasaki Jukogyo Kabushiki Kaisha, Kobe; Ishii Syoji, Ltd., Tokyo, both of Japan

[21] Appl. No.: 740,400

[22] Filed: Jun. 3, 1985

[30] Foreign Application Priority Data

Jun. 6, 1984 [JP] Japan ..... 59-116147

[51] Int. Cl.[4] ..... B02C 17/04; B02C 17/18; B02C 17/22

[52] U.S. Cl. ..... 241/182; 241/171; 241/176; 241/180

[58] Field of Search ..... 241/170, 171, 172, 173, 241/174, 176, 177, 178, 180, 182, 184

[56] References Cited

U.S. PATENT DOCUMENTS 2,098,054 11/1937 McBerty ..... 241/180 X 3,527,419 9/1970 Wienert ..... 241/174 X

*Primary Examiner*—Howard N. Goldberg

*Assistant Examiner*—Timothy U. Eley

*Attorney, Agent, or Firm*—Leydig, Voit & Mayer

[57] ABSTRACT

A liner for the outlet port of a rod mill including a cylindrical body provided on the peripheral edge of an opening of the liner and projecting outwardly through the outlet port to prevent a rod from exiting the liner. The projecting length of the cylindrical body on the side close to the end portion of the barrel of the rod mill is preferably longer than that on the opposite side.

2 Claims, 2 Drawing Figures

LINER FOR THE OUTLET PORT OF A ROD MILL

BACKGROUND OF THE INVENTION

1. Field of the Invention

This invention relates to improvements in a liner for the outlet port of a rod mill with which the inner surface of the barrel of the rod mill is lined, and more particularly to a liner for such outlet port which prevents a rod from being projected outwardly through the outlet port.

2. Description of the Related Art

In a rod mill of a type having an outlet port on its periphery on one side, it is desirable to provide the outlet port at a position as close to the end portion of the barrel as possible in order to effectively use the length of the mill.

When an outlet port is provided near the end portion of the barrel and a rod, which is a medium for pulverizing material, drops in an inclined manner during operation of the rod mill, an end portion of the rod may project outwardly through the outlet port and become caught by it, thus preventing the rod from returning to the barrel, and thereby disturbing the normal motion of other rods, which remarkably reduces the efficiency of the pulverizing operation. This tendency is especially marked in crushing and pulverizing material which places an extremely heavy load on a rod mill, such as slag produced in an ironworks.

As a result, conventionally, an outlet port has unavoidably been provided at a position 300 to 400 mm away from the end portion of a barrel. This has meant that it has inconveniently been impossible for the rod mill to be efficiently used over its entire length.

SUMMARY OF THE INVENTION

Accordingly it is an object of this invention to solve the above-described problems and to provide a liner for the outlet port of a rod mill which can prevent a rod from projecting outwardly from the barrel through the outlet port which is provided at the end portion of the barrel.

A liner for the outlet port of a rod mill according to the invention is characterized in that a cylindrical body projecting outwardly through the outlet port of the barrel is provided on the peripheral edge of the opening of the liner.

Since a liner for the outlet port of a rod mill according to the invention is provided with a cylindrical body protruding from the barrel on the peripheral edge of the opening, when a rod drops in an inclined state during operation of the rod mill and the end portion of the rod projects outwardly through the opening of the liner, the rod comes into abutment with the cylindrical body and is pushed back into the barrel with rolling of the rod mill. Thus, pulverization operation is carried out in a good state without the motion of the other rods being disturbed. Furthermore, pulverized material is discharged smoothly without any trouble. In addition, since the outlet port of the rod mill can be provided at a portion very close to the end portion of the barrel without any danger of a rod projecting outside the barrel, the rod mill is effectively usable over its entire length, and it is also possible to enlarge the outlet port for discharge of large lumps.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
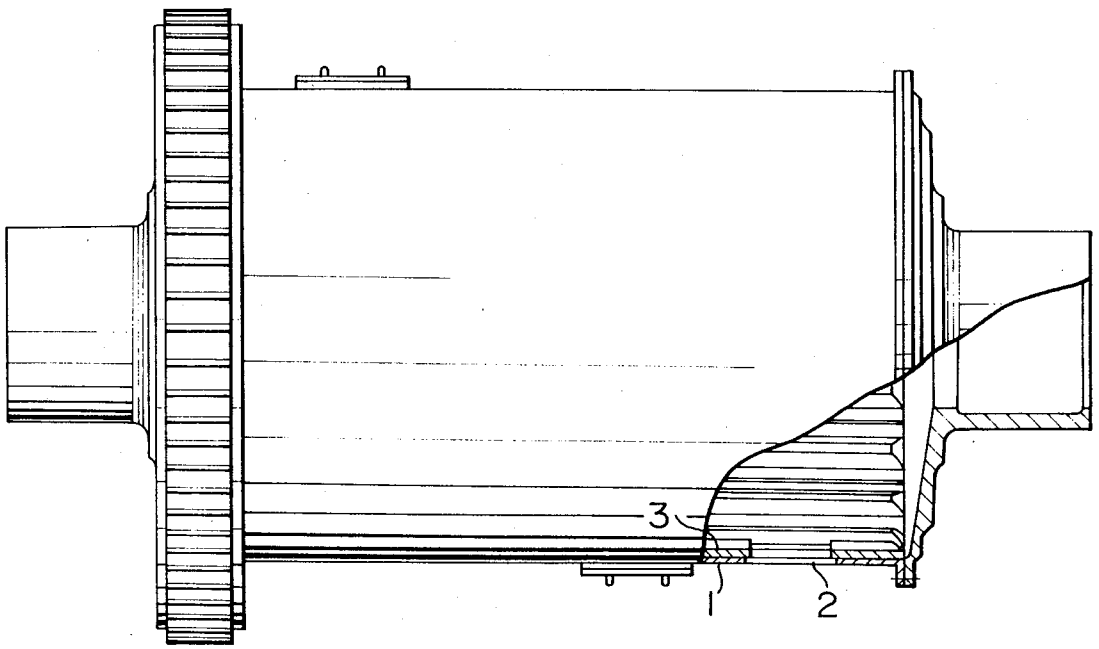
FIG. 1 PRIOR ART
FIG. 1 is a partially cutaway view of a rod mill having a liner for the outlet port as employed in the related art.

Referring first to FIG. 1, a liner for an outlet port according to the related art will be simply explained. In the vicinity of one longitudinal end portion of the barrel 1 of a rod mill, an outlet port 2 is opened in the circumference of the barrel 1. The outlet port 2 is provided at a position 300 to 400 mm away from the end portion of the barrel.

A hole matching the outlet port 2 is formed on a liner 3 with which the inner surface of the barrel 1 is lined.

Figure 2:
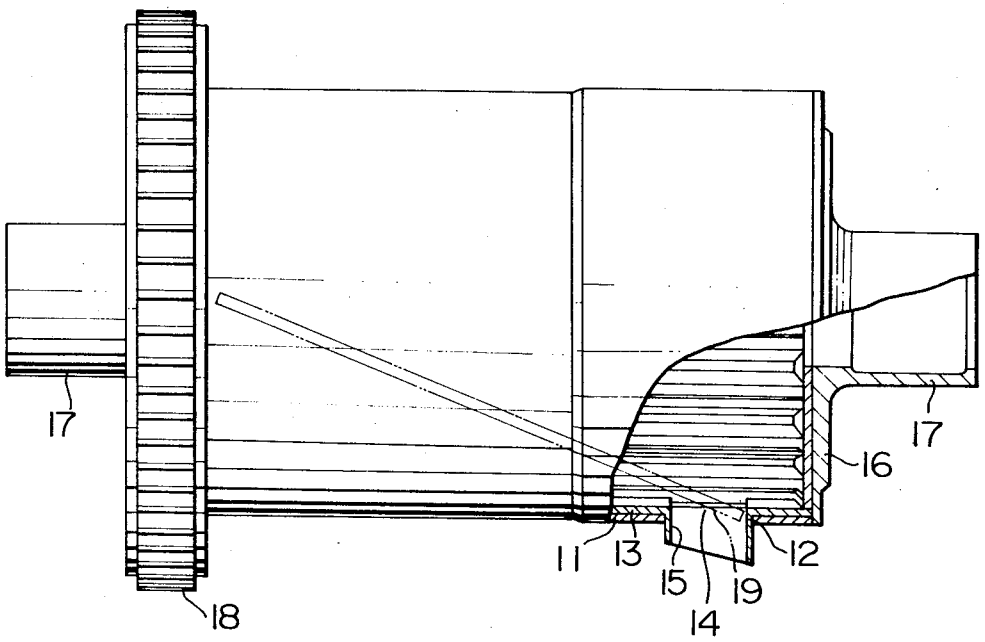
FIG. 2 is a partially cutaway view of a rod mill having an embodiment of a liner for the outlet port according to the invention.

An embodiment of a liner for an outlet port according to the invention will next be explained with reference to FIG. 2.

The reference numeral 11 represents a barrel, 12 an outlet port provided at the end portion of the barrel 11, and 13 a liner for the outlet port with which the outlet port 12 portion of the inner surface of the barrel 11 is lined. On the peripheral edge of the opening 14 of the liner 13 is provided a cylindrical body 15 projecting outwardly through the outlet port 12 of the barrel 11. The outward end of the cylindrical body 15 is inclined such that one of its projecting lengths on the trunnion side 16 which is adjacent the end portion of the barrel is longer than on the side opposite said end portion. The reference numeral 17 denotes a journal and 18 a rod mill rolling gear.

Supposing a rod 19, which is indicated by the dot and dash line, drops in an inclined manner and projects outwardly through the opening 14 of the liner 13 while material, which is charged into a rod mill having the above described structure, is being pulverized, the rod 19 comes into abutment with the cylindrical body 15 and is pushed back into the barrel 11 with the rolling of the rod mill. Therefore, the motion of the other rods is not disturbed and pulverization is conducted in a good state. Especially in the case of using large rods for treating large lumps of metals which are included in material which subjects a rolling mill to an extremely heavy load, such as slag produced in an ironworks, a large rod often drops in an inclined state, because the amount of the slag to be charged in the rod mill is small in comparison with the volume of the rod mill. In this embodiment, however, the rod projecting through the opening 14 of the liner 13 comes into contact with the cylindrical body 15 and is pushed back into the barrel 11 with the rolling of the rod mill. Accordingly, pulverization and grinding of the slag is finely carried out without disturbance of the other rods.

While there has been described what is at present considered to be a preferred embodiment of the invention, it will be understood that various modifications may be made therein, and it is intended that the appended claims cover all such modifications as fall within the true spirit and scope of the invention.

What is claimed is:

1. In combination, a rod mill comprising a barrel having a wall with an inside surface, a plurality of elongated rods adapted to be received in and extend the length of said barrel for pulverizing material upon rolling of said barrel, an outlet port provided at an end portion in the wall of the barrel and having a size large enough to allow ends of said rods to project through the port, a liner on the inside surface of said barrel at said end portion, said liner having an unobstructed opening defined by a peripheral edge at said outlet port, and means on said peripheral edge including a cylindrical body extending and projecting outwardly through said outlet port for pushing a rod, which drops in an inclined manner and projects outwardly through the unobstructed opening in the liner while material is being pulverized, and comes into abutment with the cylindrical body, back into the barrel with the rolling of the barrel.

2. The combination according to claim 1 in which said cylindrical body has a greater projecting length adjacent said end portion than on a section of said body opposite said end portion.

* * * * *